US007252103B2

(12) United States Patent
You

(10) Patent No.: US 7,252,103 B2
(45) Date of Patent: Aug. 7, 2007

(54) OPENING DEVICE OF AUTOMATIC UMBRELLA

(76) Inventor: Ching-Chuan You, Rm. 532, 5FL. No. 144, Ming Chuan E. Rd., Sec. 3, P.O. Box 1-79, Taipei (TW) 105

( * ) Notice: Subject to any disclaimer, the term of this patent is extended or adjusted under 35 U.S.C. 154(b) by 86 days.

(21) Appl. No.: 11/084,050

(22) Filed: Mar. 21, 2005

(65) Prior Publication Data

US 2006/0207638 A1 Sep. 21, 2006

(51) Int. Cl.
*A45B 25/14* (2006.01)

(52) U.S. Cl. ..... 135/22; 135/24; 135/41; 135/44

(58) Field of Classification Search ..... 135/22, 135/24, 28, 37–41, 44
See application file for complete search history.

(56) References Cited

U.S. PATENT DOCUMENTS 580,907 A * 4/1897 Stevenson ..... 135/24
3,677,274 A * 7/1972 Yasuda et al. ..... 135/24
3,856,030 A * 12/1974 Sato ..... 135/22
3,882,880 A * 5/1975 Waltz ..... 135/44
4,548,222 A * 10/1985 Day ..... 135/24
5,048,152 A * 9/1991 Gray ..... 16/110.1
5,125,426 A * 6/1992 Wu et al. ..... 135/23
5,275,186 A * 1/1994 Liu ..... 135/24
5,349,976 A * 9/1994 Ko ..... 135/25.4
5,357,994 A * 10/1994 Chung ..... 135/22
5,626,160 A * 5/1997 Ko ..... 135/22
6,684,893 B2 * 2/2004 Kuo ..... 135/24

FOREIGN PATENT DOCUMENTS

DE 4120001 * 2/1992
GB 2240038 * 7/1991
JP 6-108 * 1/1994

* cited by examiner

*Primary Examiner*—Winnie Yip

(57) ABSTRACT

Provided is an opening device mounted on a shank of automatic umbrella including a sliding sleeve having a lower extension and a slot on the extension. The device comprises an upper trigger mechanism lockingly engaged with the extension in a closed condition of the umbrella such that pressing the trigger mechanism will disengage the trigger mechanism from the extension prior to automatically opening the umbrella, and a lower, spring biased rib tip retaining mechanism put on the shank and disposed above the handle, the rib tip retaining mechanism adapted to contain tips of ribs therein in the closed condition of the umbrella. Thus, the tips of ribs are not tangled with foreign objects or other umbrellas when the umbrella is stored in, for example, an umbrella stand.

6 Claims, 8 Drawing Sheets

OPENING DEVICE OF AUTOMATIC UMBRELLA

BACKGROUND OF THE INVENTION

1. Field of Invention

The present invention relates to umbrella opening devices and more particularly to an improved opening device of an automatic umbrella, the device being capable of additionally retaining rib tips in a closed condition of the umbrella.

2. Description of Related Art

Opening devices mounted in automatic umbrellas are well known. For example, U.S. Pat. No. 6,684,893 discloses a simplified controlling apparatus of an automatic umbrella. It is characterized in that a hollow main body is adapted to receive a spring biased control loop. A surface button is resiliently secured to the control loop. As such, one pressing of the button will automatically open the umbrella and a further pressing thereof will realize a closing of the umbrella thereafter. However, the prior art suffered from several disadvantages. For example, the control loop and the button are separate members. Thus, assembly precision of them is required to be relatively high, resulting in a time consuming manufacturing process and an increase in the manufacturing cost. To the worse, it is trouble-prone and unreliable in use.

Moreover, ribs of umbrella are at a small angle about shank in a closed condition thereof. As such, storage space of the closed umbrella is not reduced to a satisfactory degree. Moreover, rib tips of a closed umbrella may be tangled with foreign objects or other umbrellas when it is stored in, for example, an umbrella stand. This not only hinders the taking of the umbrella but also may deform or even break the umbrella. Thus, the need for improvement still exists.

SUMMARY OF THE INVENTION

It is therefore an object of the present invention to provide an opening device mountable on an automatic umbrella including a shank, a handle at a lower end of the shank, a sliding sleeve on a top of the opening device and put on the shank, the sliding sleeve including a lower extension, a slot on a surface of the extension, and two opposite tabs on the surface of the extension above the slot, a plurality of folding ribs pivotal about a top of the shank, a plurality of stretchers each pivotably interconnecting an intermediate portion of the rib and a spring biased sliding ring put on the shank above the sliding sleeve, and a canopy stretched over the ribs, comprising an upper trigger mechanism on the shank being lockingly engaged with the extension in a closed condition of the umbrella, wherein a pressing of the trigger mechanism enables the trigger mechanism to disengage from the extension prior to automatically opening the umbrella, and a lower, spring biased rib tip retaining mechanism put on the shank and disposed above the handle, the rib tip retaining mechanism adapted to contain tips of the ribs therein in the closed condition of the umbrella. By utilizing the opening device, the tips of the ribs are not tangled with foreign objects or other umbrellas when the umbrella is stored in, for example, an umbrella stand. In addition, the opening device only comprises a minimum number of components, resulting in a simplification of the construction and thus a decrease in the manufacturing cost. Moreover, the opening device is trouble free and reliable in use.

In one aspect of the present invention, the trigger mechanism is a cylinder and comprises a staged member put on the shank and including an upper enlargement adapted to receive the extension, a horizontal opening on the enlargement, a recess on the inner surface of the enlargement opposing the opening, a lower tube, and at least one ring on an outer surface of the lower tube, the ring adapted to urge against a bottom of the rib tip retaining mechanism for fastening; a trigger member including a lock loop fitted in the enlargement by inserting through the opening, and a push button at the lock loop and projected from the opening, and a first resilient member aligned with the push button and anchored between the recess and the lock loop, the resilient member adapted to expand to push the lock loop outwardly to cause a portion of the lock loop to enter the slot for locking the extension in the closed condition of the umbrella.

In another aspect of the present invention, the rib tip retaining mechanism comprises a funnel put on the shank and disposed above the handle, the funnel adapted to contain tips of the ribs therein in the closed condition of the umbrella, and a second resilient member biased between the handle and the funnel for urging a bottom of the funnel against the ring.

In yet another aspect of the present invention, the funnel is operative to press down to compress the second resilient member, the tips of the folded ribs is operative to dispose above the funnel, and the funnel is operative to release to expand the second resilient member for pushing the funnel upward to contain the tips of the ribs.

The above and other objects, features and advantages of the present invention will become apparent from the following detailed description taken with the accompanying drawings.

DETAILED DESCRIPTION OF THE INVENTION

Figure 1:
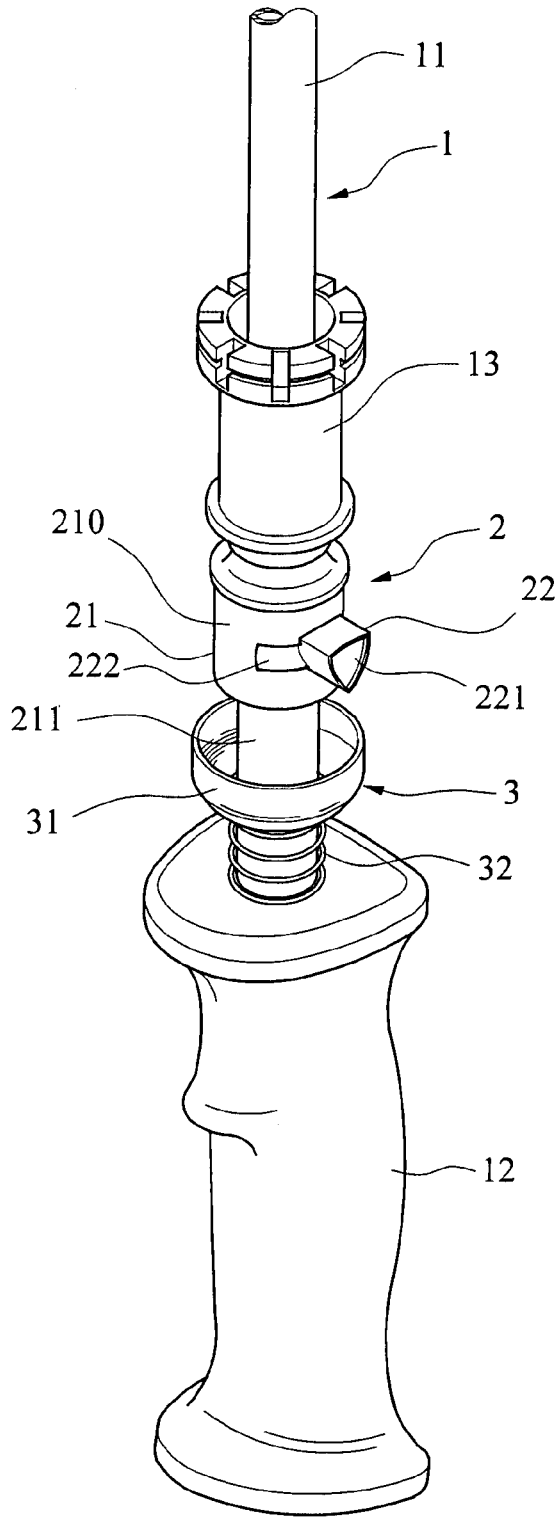
FIG. 1 is a perspective view of a preferred embodiment of opening device of automatic umbrella according to the invention mounted on a lower portion of shank proximate handle.
Figure 2:
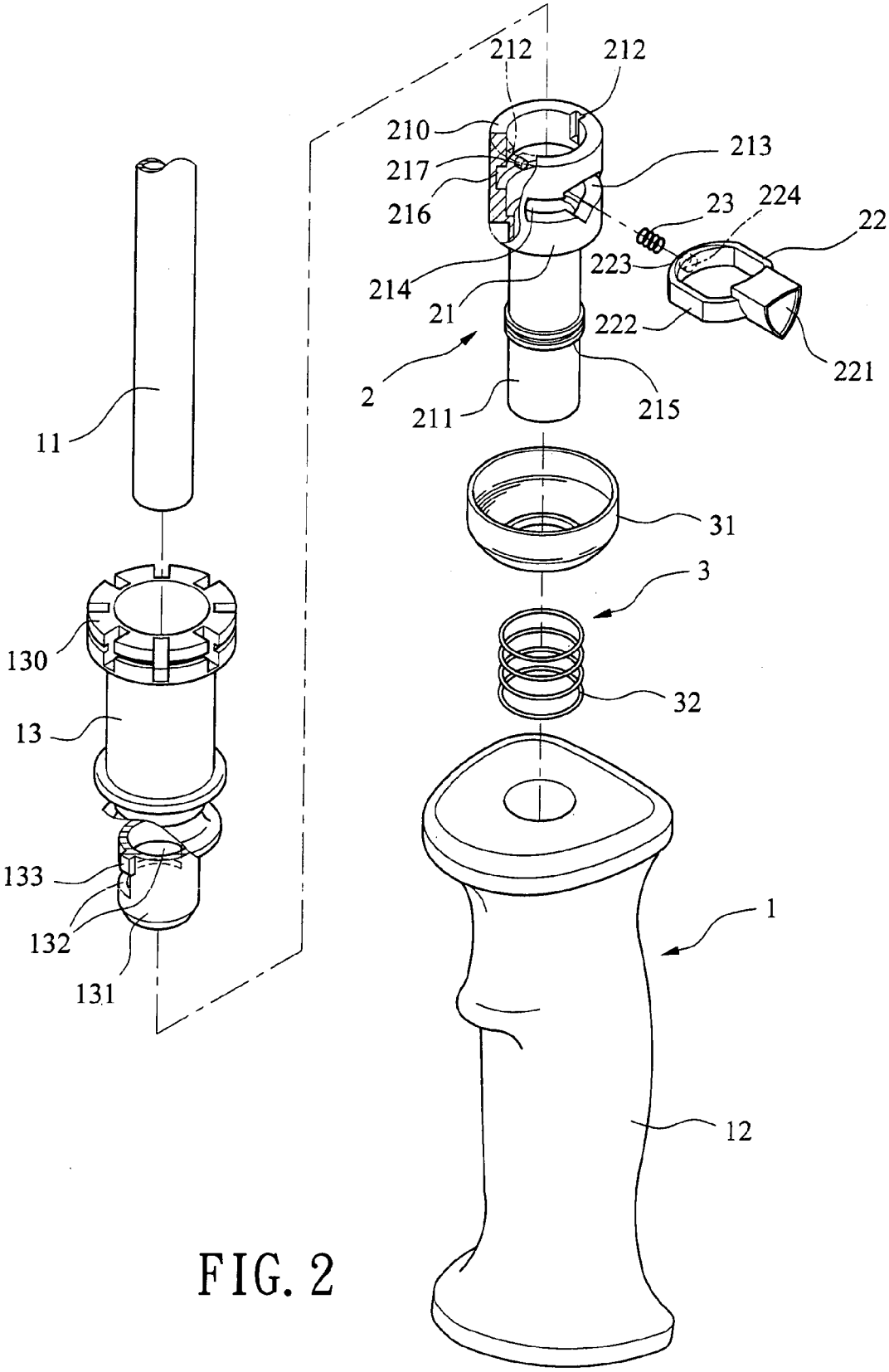
FIG. 2 is an exploded perspective view of FIG. 1 with the portions of the enlargement and the extension shown in section.
Figure 3:
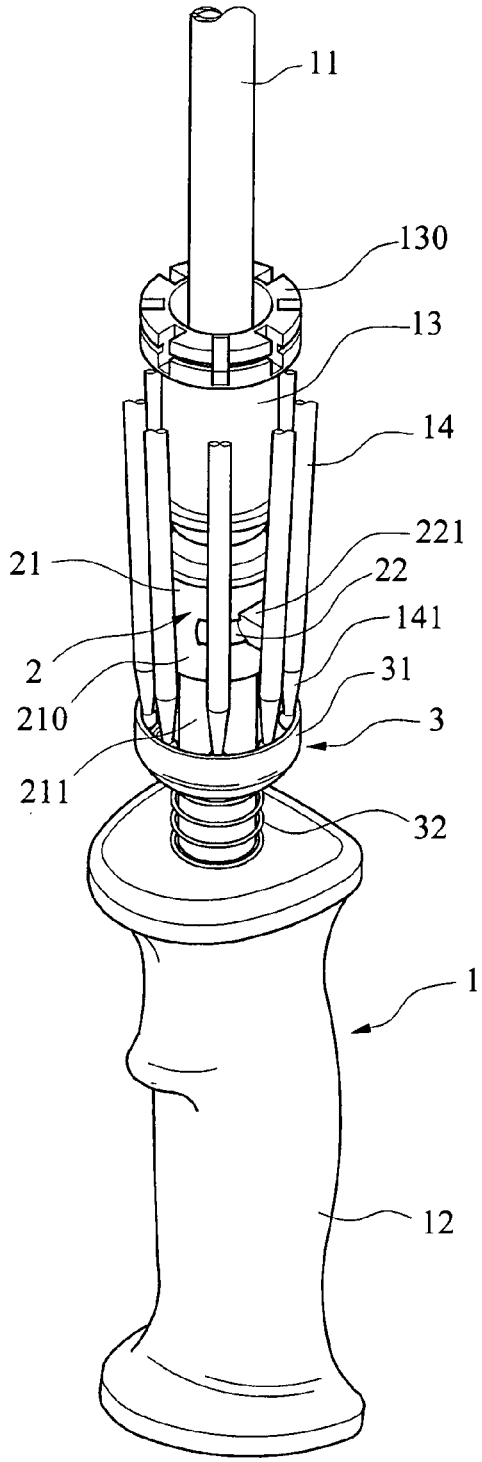
FIG. 3 is a view similar to FIG. 1, where a plurality of rib tips are retained by the opening device in a closed condition of the umbrella.

Referring to FIGS. 1 to 8, there is shown an opening device of automatic umbrella 1 in accordance with a preferred embodiment of the invention. The device is mounted on a lower portion of shank 11 and comprises an upper trigger mechanism 2 and a lower rib tip retaining mechanism 3. The umbrella 1 comprises the shank 11, a handle 12 formed at a lower end of the shank 11, a sliding sleeve 13 provided on top of the device and put on the shank 11, a plurality of folding ribs 14 pivotally connected to a top ring 18 of the shank 11, a plurality of stretchers 15 each pivotally interconnecting an intermediate portion of the rib 14 and a spring 16 biased sliding ring 17 put on the shank 11 above the sliding sleeve 13, and a canopy 19 stretched over the ribs 14. The sleeve 13 comprises a top flange 130, a lower extension 131, a slot 132 on a surface of the extension 131, and two opposite tabs 133 formed on an outer surface of the extension 131 above two ends of the slot 132.

The cylindrical trigger mechanism 2 comprises an integral staged member 21 put on the shank 11 and including an upper, hollow, cylindrical enlargement 210 and a lower tube 211, the enlargement 210 for neatly receiving the extension 131, two opposite cavities 212 on an inner surface of the enlargement 210 adapted to slidably receive the tabs 133, an arc-shaped well 216 below two opposite cavities 212 on an inner surface of the enlargement 210, a projection 217 disposed on a middle of the well 216, a horizontal opening 213 on the enlargement 210, a slot 214 on the inner surface of the enlargement 210 extending from either end of the opening 213, and a plurality of parallel rings 215 closely formed on an outer surface of the lower tube 211; a trigger member 22 including a lock loop 222 having a front portion 223 received in the well 216, a recess 224 in the middle, and a rear push button 221 projecting from the opening 213, the lock loop 222 fitted in the enlargement 210 by inserting through the opening 213 and the slot 214, a coil spring 23 resiliently anchored between the projection 217 and the recess 224 of the lock loop 222 opposing the push button 221. That is, the projection 217, the spring 23 the recess 224, and the push button 221 are aligned. The spring 23 is expanded to push the lock loop 222 outwardly to cause the front portion 223 of the lock loop 222 to enter the slot 132 and the well 216 for locking the extension 131 (i.e., the sleeve 13) in a closed condition of the umbrella (see FIG. 4).

The rib tip retaining mechanism 3 comprises a funnel 31 and a coil spring 32 biased between the handle 12 and the funnel 31 for urging a bottom of the funnel 31 against a lowest one of the rings 215. The funnel 31 is thus fastened.

Figure 4:
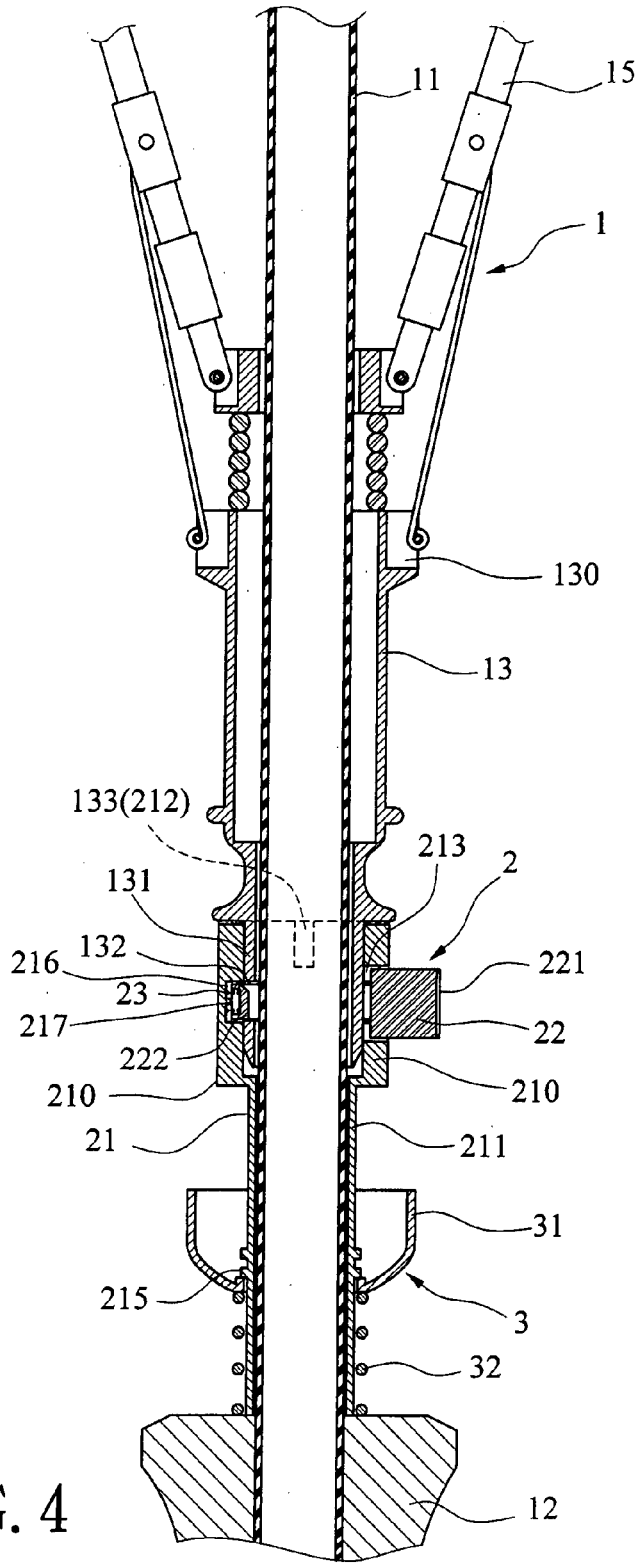
FIG. 4 is a sectional view of FIG. 1, where the umbrella is closed.
Figure 5:
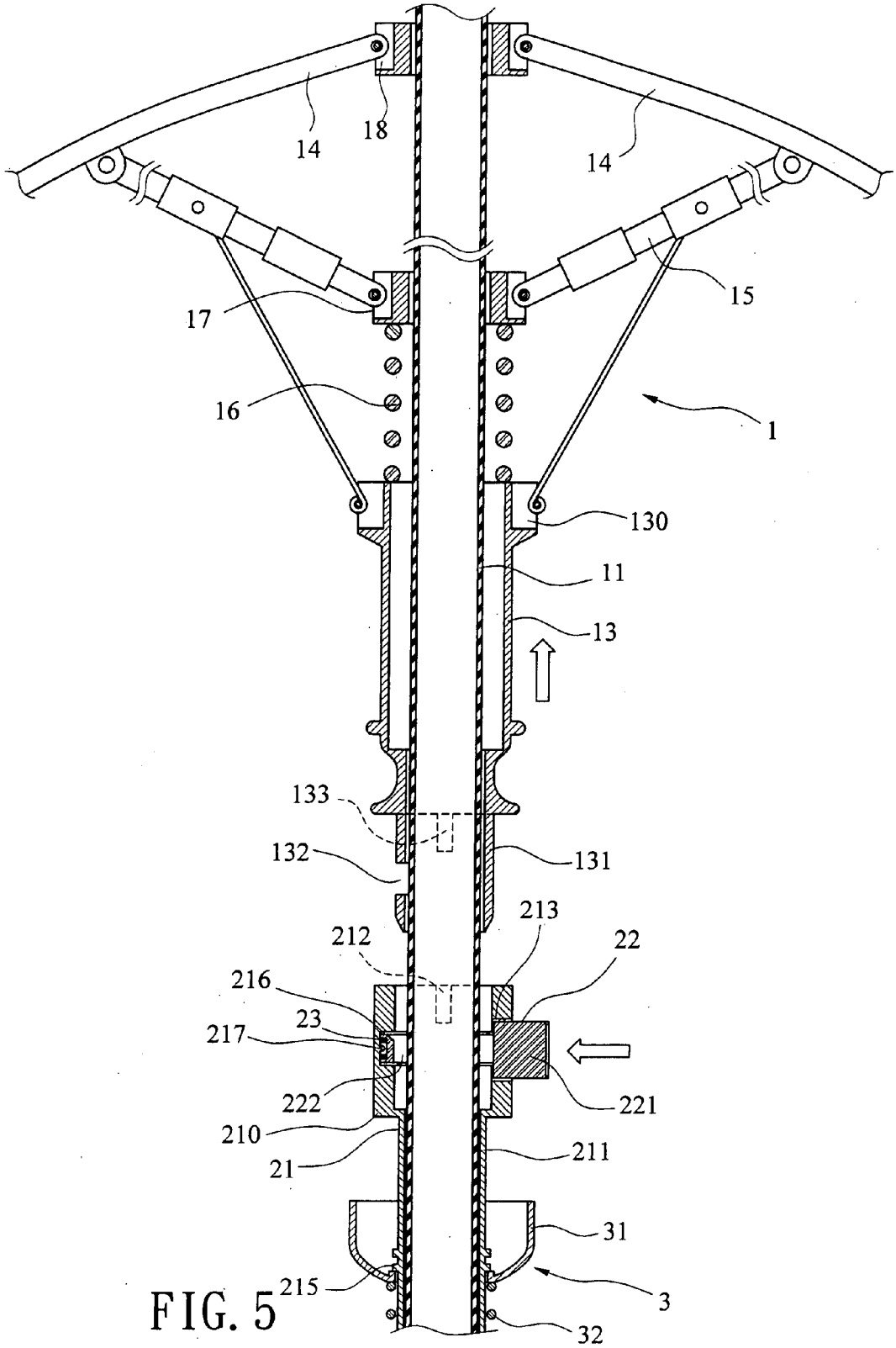
FIG. 5 is a view similar to FIG. 4, where the umbrella is automatically opened after pressing the push button.
Figure 6:
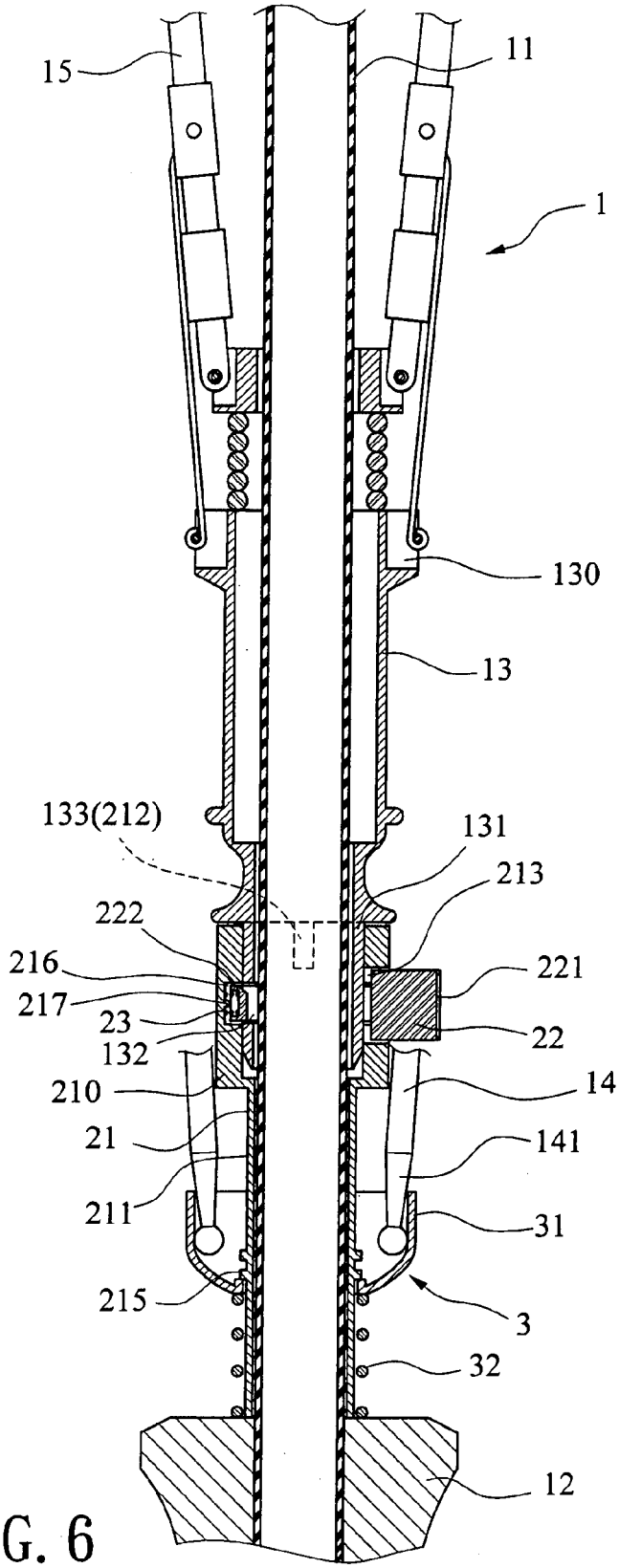
FIG. 6 is a sectional view of FIG. 3.
Figure 7:
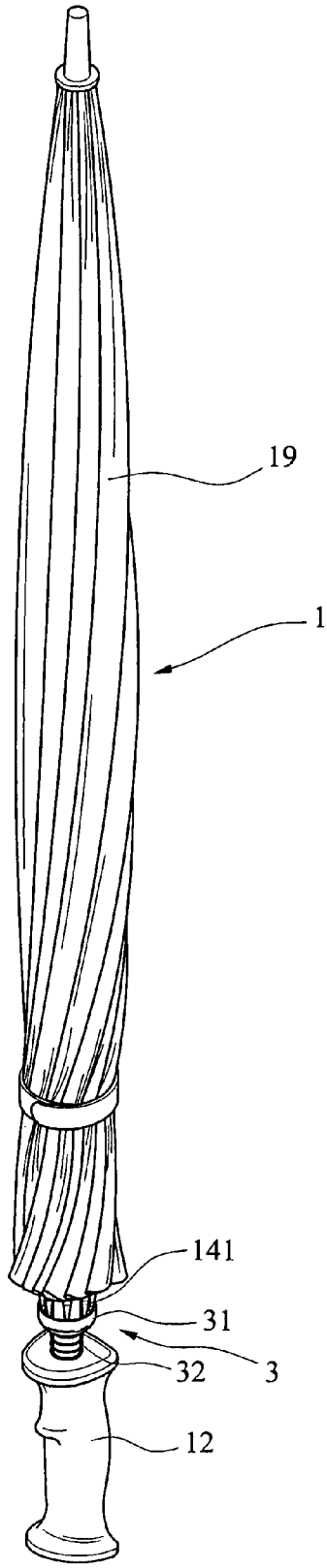
FIG. 7 is a perspective view of the automatic umbrella with canopy tied by a tie closure in its closed condition.
Figure 8:
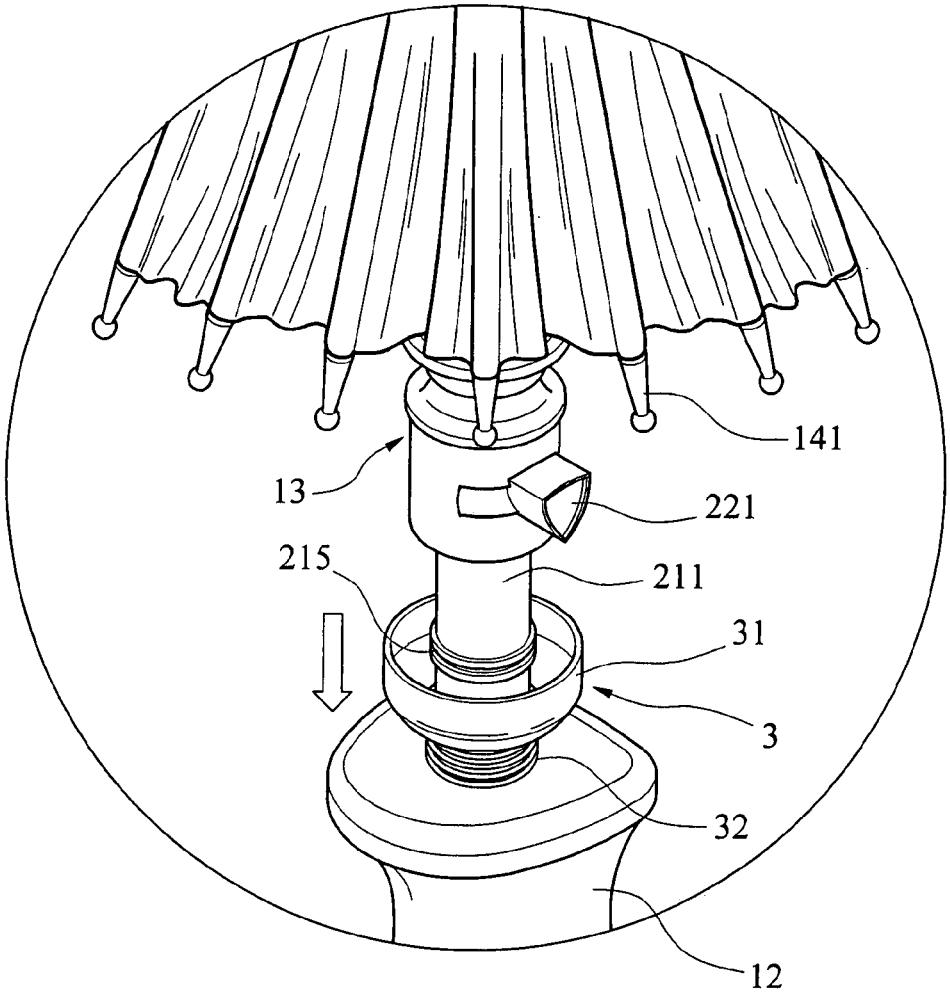
FIG. 8 is a perspective view of the opening device and its adjacent components showing rib tips being unfastened by pressing down the funnel.

For opening the umbrella, simply press the push button 221 to move the lock loop 222 laterally to compress the spring 23 until the lock loop 222 clears the slot 132. The extension 131 (i.e., the sleeve 13) thus disengages from the enlargement 210 by jumping upward. As a result, the umbrella is automatically opened (see FIG. 5). Once the pressing is not applied, the energized spring 23 (i.e., compressed) immediately pushes the lock loop 222 outwardly to cause the lock loop 222 to return to its original position again as shown in FIG. 4.

For closing the umbrella, first press down the funnel 31 to compress the spring 32. Next, put the folded rib tips 141 above the funnel 31. Next, release the funnel 31 to contain the rib tips 141 therein due to the expansion of the spring 32 (see FIG. 6). Next, tie the canopy 19 by a tie closure in a closed condition of the umbrella 1 (see FIG. 7). In this state, the storage space of the umbrella 1 is reduced to a minimum. For opening the umbrella 1 again, a person may press down the funnel 31 toward the handle 12 to cause the rib tips 141 to clear the funnel 31 by compressing the spring 32. It is clear that the funnel 31 will return to its original position after releasing the funnel 31 and by the expansion of the spring 32.

The rib tips 141 are not tangled with foreign objects or other umbrellas when the umbrella is stored in, for example, an umbrella stand as conceived by the invention. In addition, the device only comprises a minimum number of components, resulting in a simplification of the construction and thus a decrease in the manufacturing cost.

While the invention herein disclosed has been described by means of specific embodiments, numerous modifications and variations could be made thereto by those skilled in the art without departing from the scope and spirit of the invention set forth in the claims.

What is claimed is:

1. An opening device mountable on an automatic umbrella including a shank, a handle at a lower end of the shank, a sliding sleeve on a top of the opening device and put on the shank, the sliding sleeve including a lower extension, an arc-shaped slot on the extension, a plurality of folding ribs pivotally connected to a top ring of the shank, a spring biased sliding ring put on the shank above the sliding sleeve, a plurality of stretchers each pivotably interconnecting an intermediate portion of the rib and the sliding ring, and a canopy stretched over the ribs, comprising:

an upper trigger mechanism on the shank being lockingly engaged with the extension in a closed condition of the umbrella, wherein a pressing of the trigger mechanism enables the trigger mechanism to disengage from the extension prior to automatically opening the umbrella, and a lower, spring biased rib tip retaining mechanism put on the shank and disposed above the handle, the rib tip retaining mechanism adapted to contain tips of the ribs therein in the closed condition of the umbrella;

wherein the sliding sleeve further comprises two opposite tabs on an outer surface of the extension above two ends of the slot.

2. The opening device of claim 1, wherein the trigger mechanism comprises:

a cylindrical staged member put on the shank and including an upper hollow enlargement adapted to receive the extension, the enlargement including a horizontal opening and a slot extending from either end of the opening in communication with inside of the enlargement, two opposite cavities on an inner surface adapted to slidably receive the tabs, an arc-shaped well below two opposite cavities on the inner surface, and a projection in a middle of the well, and a lower tube;

a trigger member including a lock loop fitted in the enlargement by inserting through the horizontal opening and the slot, the lock loop having an arc-shaped front portion received in the well and a recess in a middle of the front portion, and a push button projecting from the horizontal opening, and a first resilient member aligned with the push button and anchored between the projection and the recess, the resilient member adapted to expand to push the lock loop outwardly to cause the front portion of the lock loop to enter the well and the slot for locking the extension in the closed condition of the umbrella.

3. The opening device of claim 2, wherein the lock loop is formed integrally with the push button.

4. The opening device of claim 2, wherein the lower tube comprises at least one ring member on an outer surface, the ring member adapted to urge against a bottom of the rib tip retaining mechanism for fastening.

5. The opening device of claim 4, wherein the rib tip retaining mechanism comprises a funnel put on the shank and disposed above the handle, the funnel adapted to contain tips of the ribs therein in the closed condition of the umbrella, and a second resilient member biased between the handle and the funnel for urging a bottom of the funnel against the ring member.

6. The opening device of claim 5, wherein the funnel is operative to press down to compress the second resilient member, the tips of the folded ribs are operative to dispose above the funnel, and the funnel is operative to release to expand the second resilient member for pushing the funnel upward to contain the tips of the ribs.

* * * * *